US008662708B2

(12) United States Patent
Lin et al.

(10) Patent No.: US 8,662,708 B2
(45) Date of Patent: Mar. 4, 2014

(54) DOUBLE HEAT SINK LED TUBE

(75) Inventors: Ming-Te Lin, New Taipei (TW); Ming-Yao Lin, New Taipei (TW); Heng Qiu, New Taipei (TW)

(73) Assignee: Uniled Lighting Taiwan Inc., New Taipei (TW)

( * ) Notice: Subject to any disclaimer, the term of this patent is extended or adjusted under 35 U.S.C. 154(b) by 239 days.

(21) Appl. No.: 13/275,803

(22) Filed: Oct. 18, 2011

(65) Prior Publication Data

US 2013/0094199 A1 Apr. 18, 2013

(51) Int. Cl.
*F21V 33/00* (2006.01)

(52) U.S. Cl.
USPC ..... 362/254; 362/249.02; 362/311.02; 362/373; 362/800; 313/44; 313/46

(58) Field of Classification Search
USPC ..... 362/249.02, 311.02, 218, 254, 373, 362/294, 547, 800; 313/40–47
See application file for complete search history.

(56) References Cited

U.S. PATENT DOCUMENTS

| | | | | |
|---|---|---|---|---|
| 7,744,251 | B2 * | 6/2010 | Liu et al. | 362/294 |
| 2003/0214810 | A1 * | 11/2003 | Zhang | 362/294 |
| 2005/0041428 | A1 * | 2/2005 | Zhang | 362/294 |
| 2009/0284972 | A1 * | 11/2009 | Chang | 362/249.02 |
| 2010/0091497 | A1 * | 4/2010 | Chen et al. | 362/249.06 |

* cited by examiner

*Primary Examiner* — Laura Tso
(74) *Attorney, Agent, or Firm* — Lowe Hauptman & Ham, LLP

(57) ABSTRACT

A LED tube having double heat sinks is disclosed. One of the embodiment shows a first plurality of light unit is fixed onto the top heat sink, and a second plurality of light unit is fixed onto the bottom heat sink, while with the light chips configured in between the two heat sinks for light emission to the ambient.

18 Claims, 15 Drawing Sheets

Fig.3A
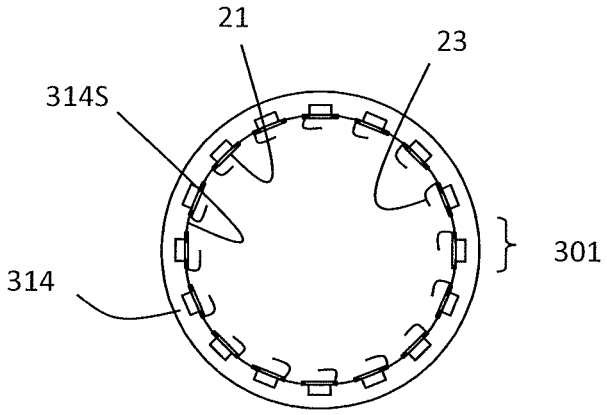
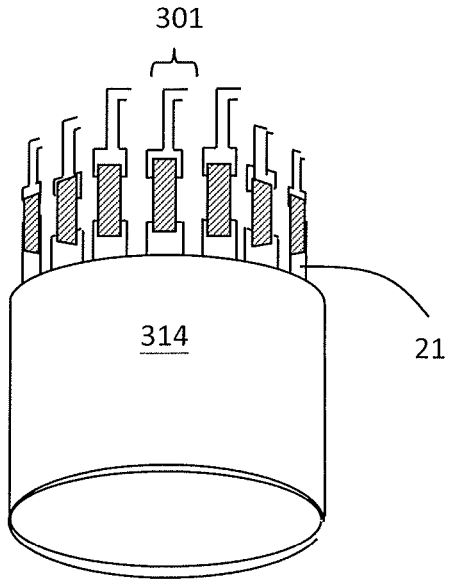
Fig.3B

Fig.4A
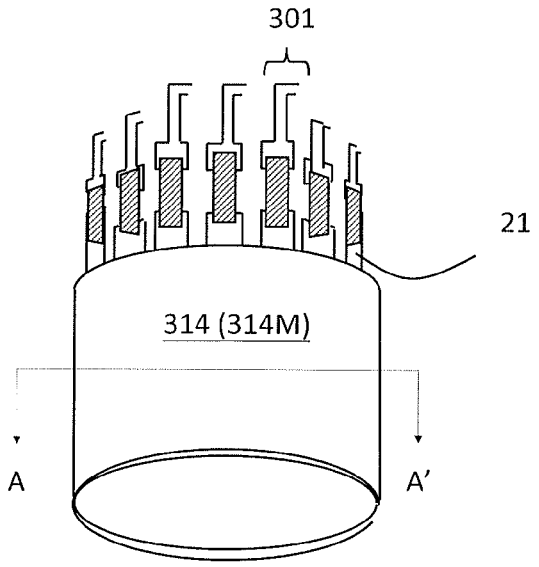
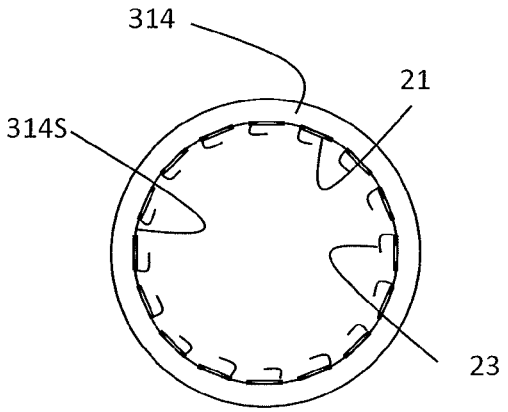
Fig.4B
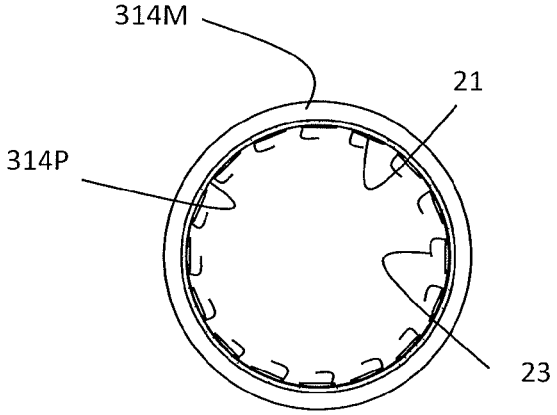
Fig.4C

DOUBLE HEAT SINK LED TUBE

BACKGROUND

1. Technical Field

The present invention relates to a LED tube, especially to a LED light tube which has a top heat sink and a bottom heat sink for heat dissipation with light chips configured in between the two heat sinks.

2. Description of Related Art

FIG. 1 is a prior art.

U.S. Pat. No. 7,434,964 discloses a LED lamp with a heat sink assembly which includes a plurality of LED modules mounted on periphery of a heat sink 30. Each of the LED modules includes a plurality of LED 54 mounted on a front side of a circuit board 52. A plurality of heat pipes 40 attached to interior of the heat sink 30. A bowl-shaped cover 20 attached to a bottom portion of the heat sink 30, a lamp seat 10 secured below the cover. The bulky of the heat sink 30 makes the lamp heavy and the heat pipes 40 advances the cost of the lamp. A simpler structure with better heat dissipation and cost down LED lamp is desirous to be conceived.

BRIEF DESCRIPTION OF THE DRAWINGS

FIGS. 3A~3B are elements for the LED tube according to the present invention.

FIGS. 4A~4C show heat sinks according to the present invention.

DETAILED DESCRIPTION OF THE INVENTION

Figure 1:
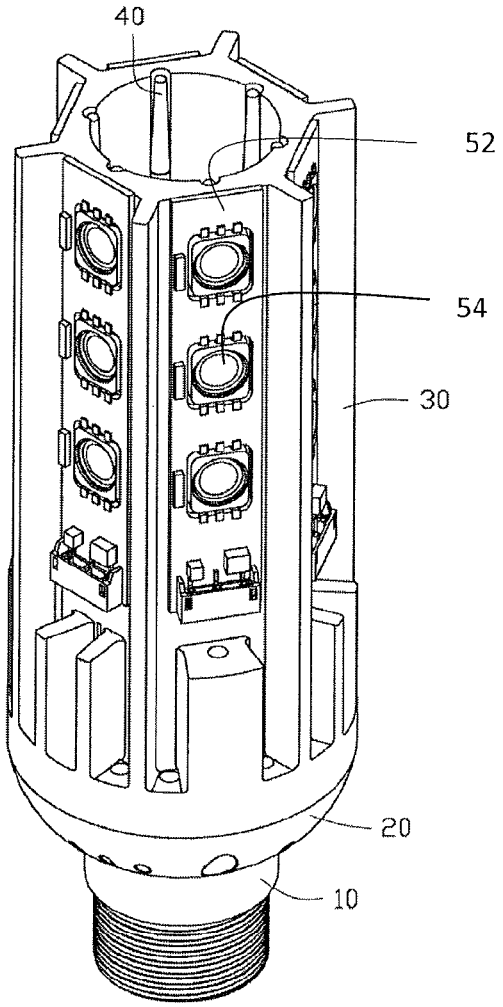
Fig.1 Prior Art
FIG. 1 is a prior art.
Figure 2A:
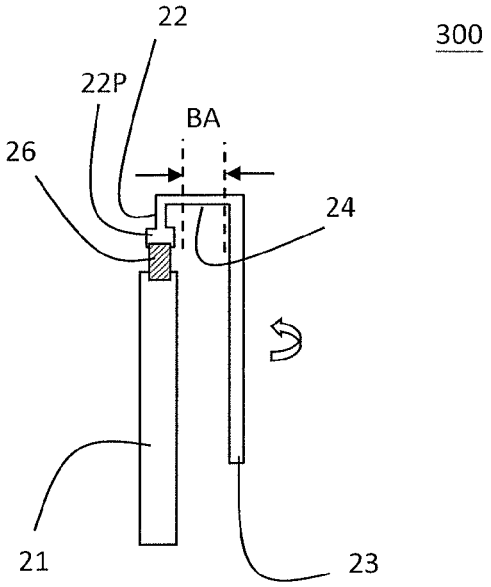
FIGS. 2A~2B are light units according to the present invention.
Figure 2B:
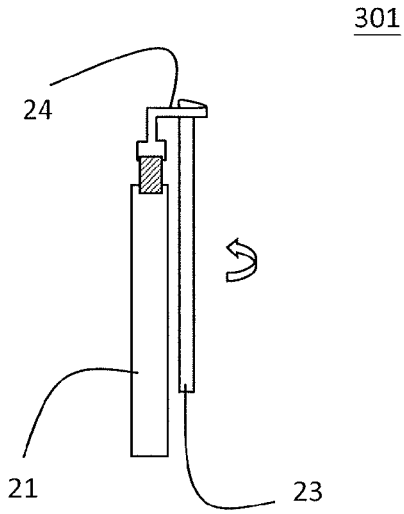

FIGS. 2A~2B are light units according to the present invention.

FIG. 2A discloses a first light unit 300 which can be used according to the present invention. The light unit 300 shows that a first metal lead 21 and an angled metal lead are used. The angled metal lead has a short downward branch 22 and a long downward branch 23. The short downward branch 22 is aligned with the top of the first metal lead 21, and has a front surface coplanar with a front surface of the first metal lead 21. A lateral metal 24 bridges the short downward branch 22 and the long downward branch 23 on top. The lateral metal 24 has a bendable area BA in the middle which can be bent backward. A light chip 26 straddles the pad 22P and the top of the metal lead 21.

FIG. 2B shows a second light unit 301 which can be used according to the present invention. The light unit 301 shows that a bendable area BA in the middle of the lateral metal 24 is bent backward so that the front side of the light unit 301 occupies less area. More light units 301 can be mounted for increasing the light emission intensity.

FIGS. 3A~3B are elements for the LED tube according to the present invention.

FIG. 3A shows a top view of FIG. 3B. FIG. 3A shows that each of the lower portion of the metal lead 21 attaches onto the inner surface 314S of the circular wall heat sink 314 for heat dissipation. The long branch 23 of the light unit 301 is configured behind for advancing the density of the light unit 301 in front to be mounted onto the heat sink 314 while in comparison with the usage of light unit 300 which occupies wider space in front.

FIG. 3B shows that a plurality of light unit 301 attaches its lead 21 onto an inner surface 314S of a circular wall heat sink 314. The heat generated from the light unit 301 is transferred to the heat sink 314 for heat dissipation.

FIGS. 4A~4C show heat sinks according to the present invention.

FIG. 4A is the same as the one shown in FIG. 3B. The heat sink 314 can be made of ceramic, alternatively, the heat sink 314M can be made of metal lined with insulation material on the inner surface.

FIG. 4B shows a section view according to line AA' of FIG. 4A. A ceramic circular wall heat sink 314 is used. A plurality of light unit 301 is mounted onto the inner surface 314S of the heat sink 314. The lower portion of metal lead 21 of each light unit 301 attaches onto the inner surface 314S of the heat sink 314.

FIG. 4C shows a section view according to line AA' of FIG. 4A. A metal circular wall heat sink 314M is used. An insulation material 314P is coated over the inner surface 314S. A plurality of light unit 301 is mounted onto the insulation material 314P of the heat sink 314. The lower portion of metal lead 21 of each light unit 301 attaches onto the inner surface of the insulation material 314P.

Figure 5:
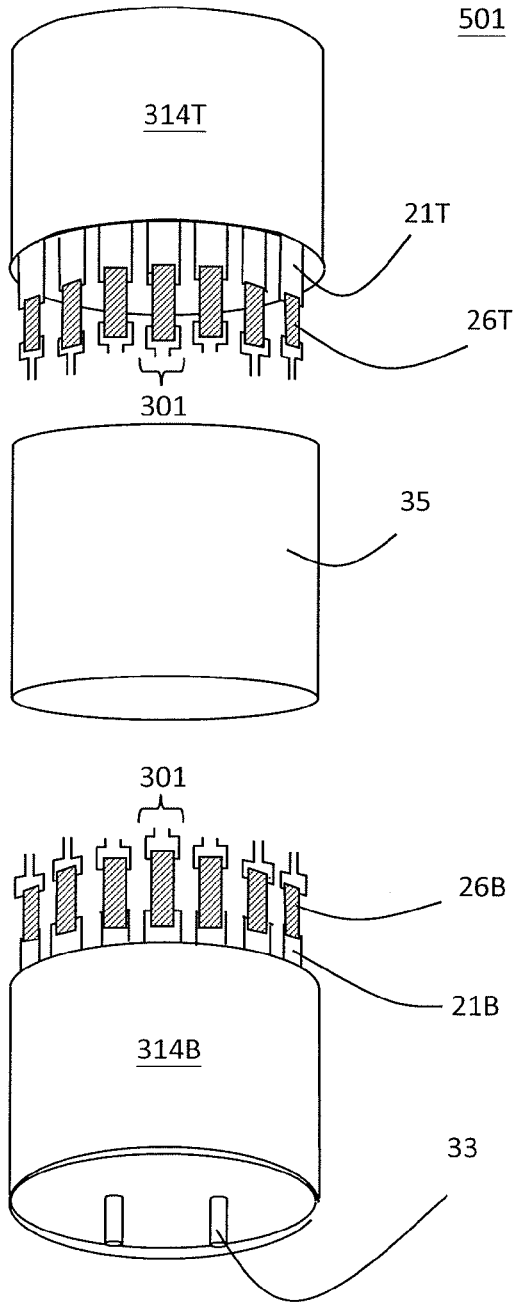
FIGS. 5-6 show a first LED tube according to the present invention.
Figure 6:
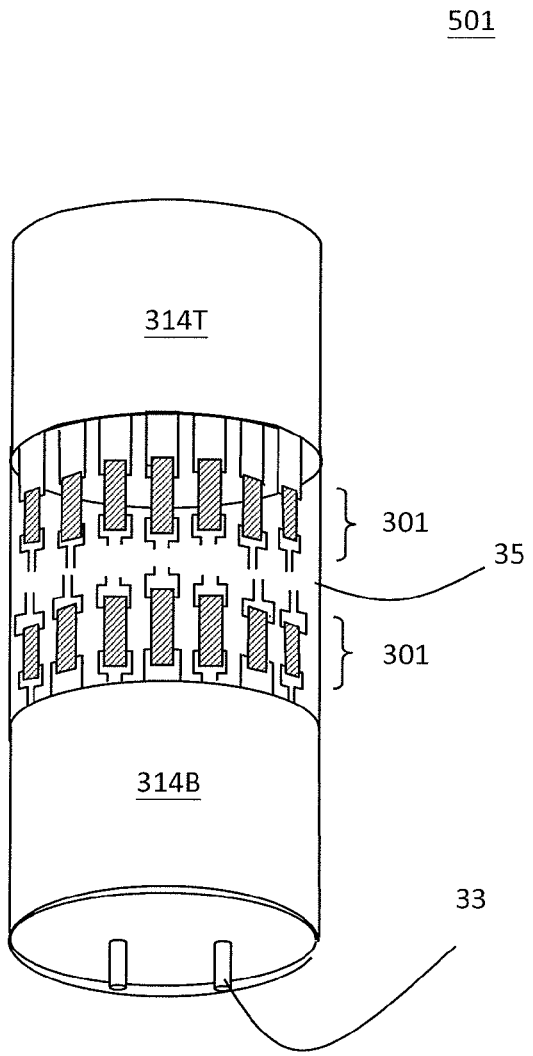

FIGS. 5-6 show a first LED tube according to the present invention.

FIG. 5 shows an explosion drawing for the first LED tube 501 with double heat sinks according to the present invention.

The top one discloses that a first plurality of light unit 301 is attached onto a top heat sink 314T with lead 21T while keeping the first light chip 26T below the heat sink 314T for light emission to the ambient. The middle one is a transparent protection tube 35. The bottom one discloses that a second plurality of light unit 301 is attached onto a bottom heat sink 314B with lead 21B while keeping the second light chip 26B above the bottom heat sink 314B for light emission to the ambient.

FIG. 6 shows an assembly of the components of FIG. 5

FIG. 6 shows that the first double heat sink LED tube 501 has a first plurality of light unit 301 configured onto the inner surface of the top circular wall heat sink 314T. A second plurality of light unit 301 is configured onto the inner surface of the bottom circular wall heat sink 314B. The first light unit 301 is configured above the second light unit 301. The protection tube 35 is configured in between the two heat sinks 314T, 314B for protecting each light unit 301 from being contaminated by the ambient dust. Two electrode pins 33 can be configured on the bottom of the bottom heat sink 314B. Each of the pins 33 has a top end electrically coupling to the light chip, and has a second end protruded out of the bottom heat sink 314B.

Figure 7:
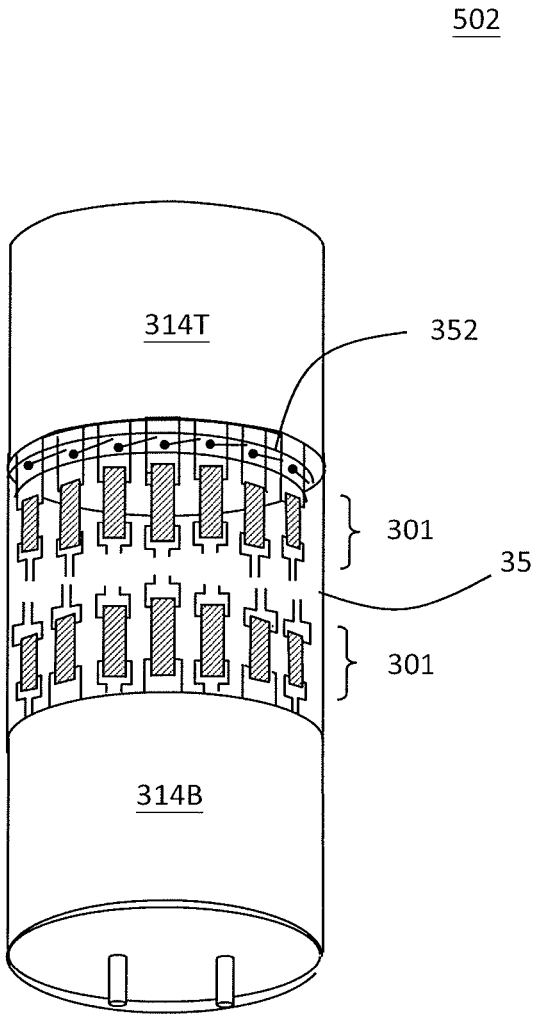
FIG. 7 shows a second LED tube according to the present invention.

FIG. 7 shows a second LED tube according to the present invention.

FIG. 7 shows a second LED tube 502. This embodiment is a modification embodiment to the one shown in FIG. 6. The difference is that FIG. 7 adds a flexible circuit 352 onto the leads of the light unit 301. The flexible circuit 352 is attached onto the leads of the light unit 301. A plurality of circuit is made on the circuit board 352. One of the circuit has a first end electrically coupling to a lead of the light unit 301, and has a second end electrically coupling to a control center (not shown) for controlling the on/off of the corresponding light tube 301.

Figure 8:
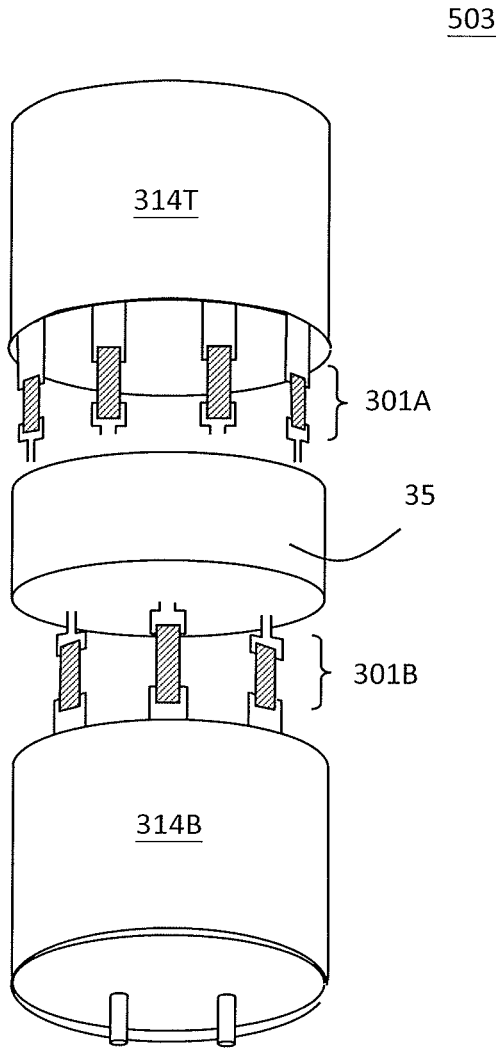
FIGS. 8-9 show a third LED tube according to the present invention.
Figure 9:
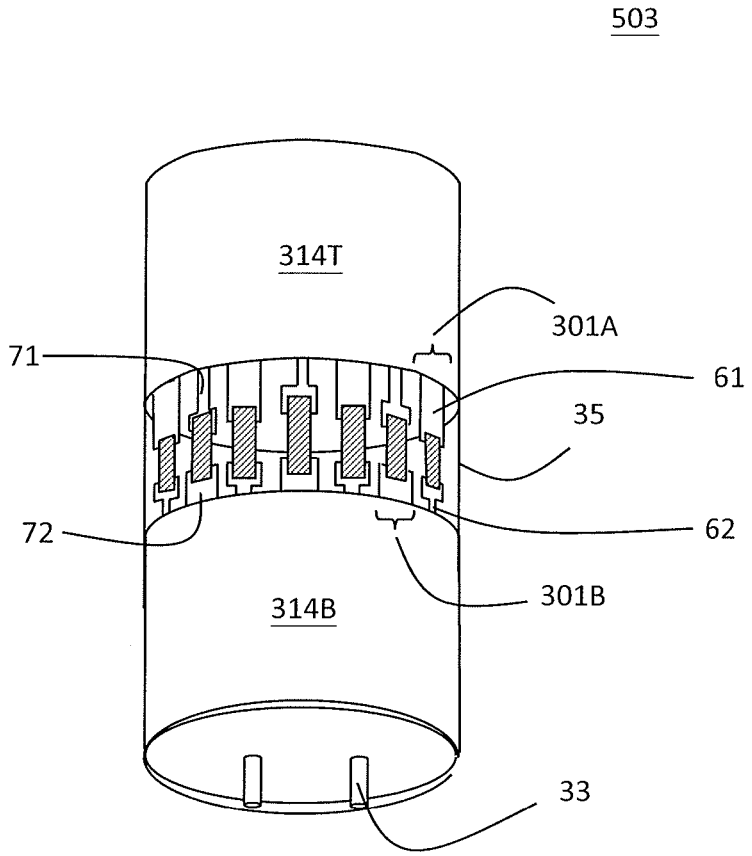

FIGS. 8-9 shows a third LED tube according to the present invention.

FIG. 8 is similar to FIG. 5 and FIG. 9 is similar to FIG. 6. The difference is that FIG. 8 shows the light units 301A mounted on the top heat sink 314T are made alternately with reference to the light units 301B mounted on the bottom heat sink 314B. FIG. 8 shows an explosion drawing of the third LED tube 503. The top one discloses a first plurality of light unit 301A mounted on the top heat sink 314T. The middle one is a transparent protection tube 35. The bottom one discloses a second plurality of light unit 301B configured on the bottom heat sink 314B.

FIG. 9 shows the assembly of the components of FIG. 8. FIG. 9 shows that the alternate light units 301A, 301B are finally arranged side by side horizontally.

The LED tube 50 has a first light unit 301A with a top lead 61 and a bottom lead 62. A first light chip straddles the top lead 61 and the bottom lead 62. A top heat sink 314T contacts a top portion of the top lead 61. A second light unit 301B has a top lead 71 and a bottom lead 72. A second light chip straddles the top lead 71 and the bottom lead 72. A bottom heat sink 314B contacts a lower portion of the bottom lead 72.

Figure 10:
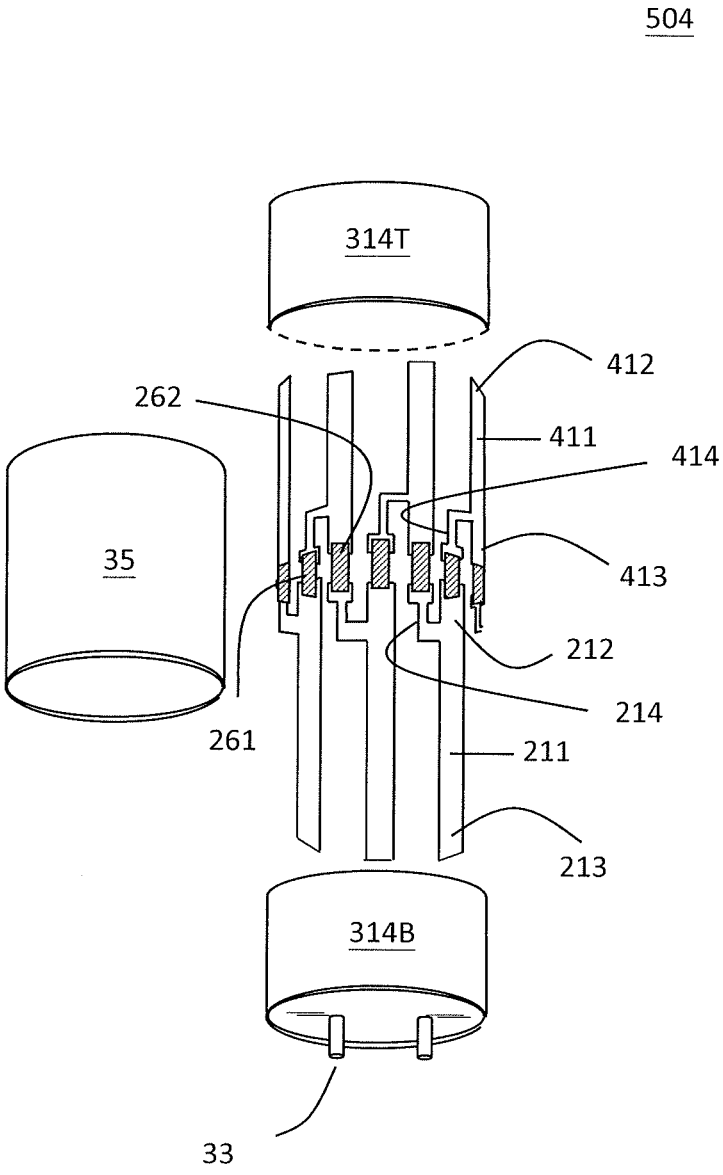
FIGS. 10-11. show a fourth LED tube according to the present invention.
Figure 11:
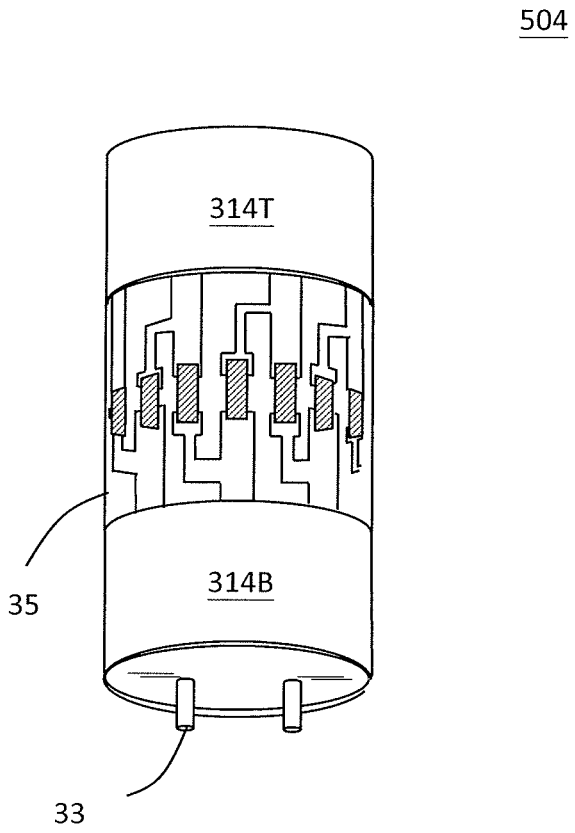

FIGS. 10-11. show a fourth LED tube according to the present invention.

FIG. 10 is an explosion drawing for the fourth LED tube 504. The top one is a top heat sink 314T. The middle left is a protection tube 35. The middle right is the light unit. The bottom one is a bottom heat sink 314B with two pins 33 on bottom.

The middle right light unit has a top lead 411 which has a top end 412, a bottom end 413, and a left downward branch 414. A bottom lead 211 has a top end 212 aligned with the downward branch 414, and has an upward branch 214 aligned with a bottom end of a neighboring top lead 412. A first light chip straddles a bottom end of the downward branch 414 and the top 212 of the bottom lead 211. A second light chip straddles the bottom end of a neighboring top lead 411 and a top end of the upward branch 214.

FIG. 11 is an assembly of the components of FIG. 10. The top heat sink 314T contacts lead 411 for heat dissipation. The bottom heat sink 314B contacts lead 211 for heat dissipation while keeping the light chips in between the two heat sinks for light emission to the ambient. Two electrode pins 33 are configured on bottom of the bottom heat sink 314B; each of the pins has a top end electrically coupling to the light unit, and has a second end protruded out of the bottom heat sink 314B.

Figure 12:
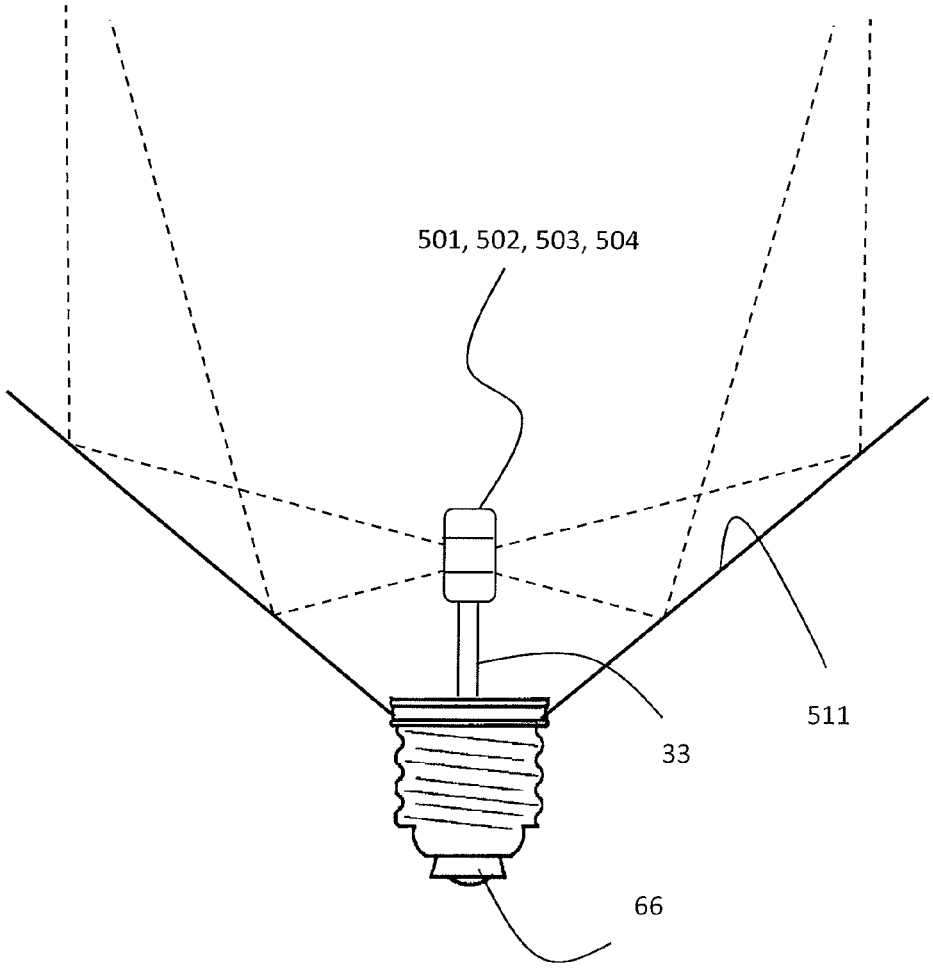
FIG. 12. shows a projection lamp employing the LED tube according to the present invention.

FIG. 12. shows a projection lamp employing the LED tube according to the present invention.

FIG. 12 shows a cup lamp using the double heat sink LED tube 501 (502, 503, 504) as its light source. The projection lamp has a reflection cup which has a reflection inner surface 511 for reflecting the light beams emitted from the LED tube 501 (502, 503, 504). A traditional lamp screw base 66 is attached on the bottom of the cup lamp. The electrode pins 33 of the LED tube electrically couple to the lamp screw base 66.

Figure 13:
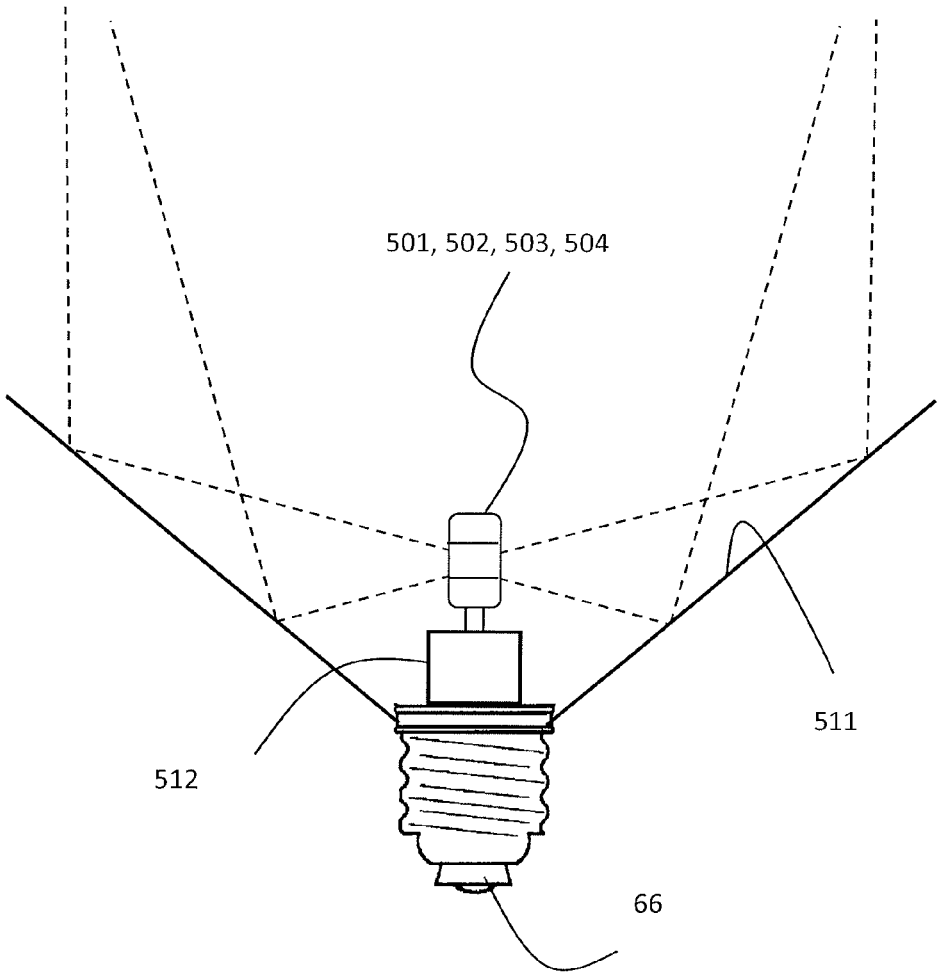
FIG. 13 shows a modification embodiment to FIG. 12 according to the present invention.

FIG. 13 shows a modification embodiment to FIG. 12 according to the present invention.

FIG. 13 shows an adjusting block 512 can be configured in between the light source 501 and the lamp screw base 66 for adjusting the height of the light source 501. The adjusting block 512 electrically couples the light source 501 to the lamp screw base 66.

Figure 14:
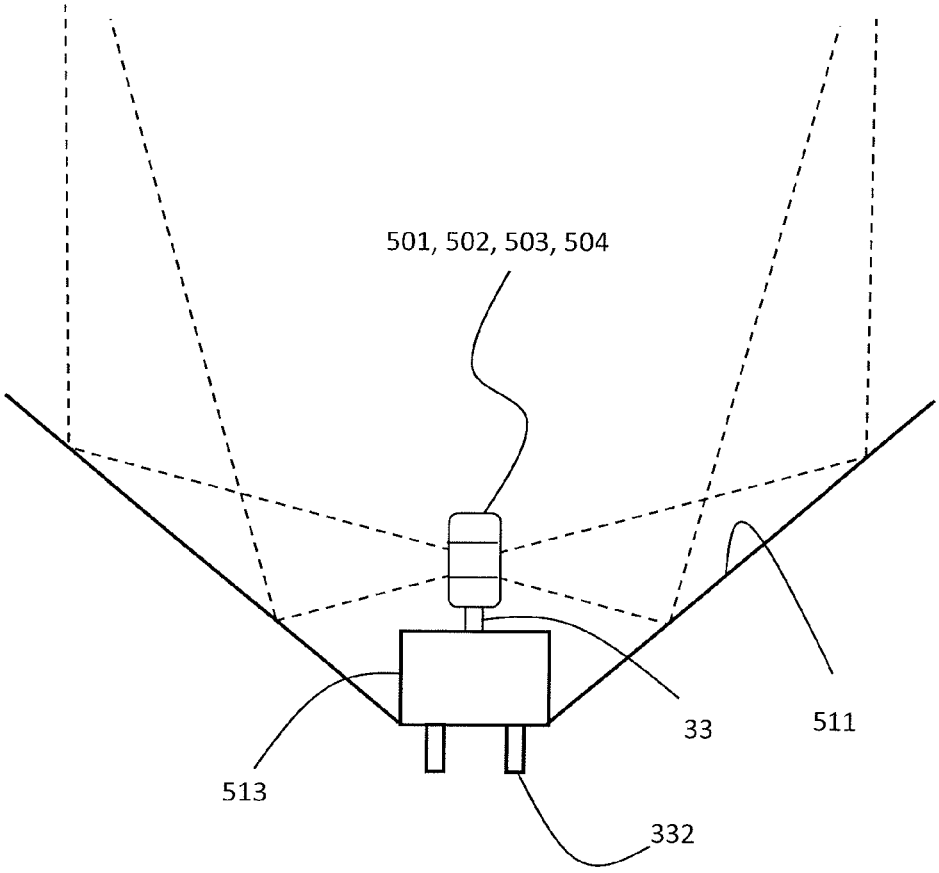
FIG. 14 shows a further lamp employing the LED tube according to the present invention.

FIG. 14 shows a further lamp employing the LED tube according to the present invention.

FIG. 14 shows that a base 513 is configured on the bottom of the light source 501 (502, 503, 504). Two electrode pins 332, each has a top end electrically coupling one of the leads 33, and has a bottom end protruded out of the bottom of the base 513.

Figure 15:
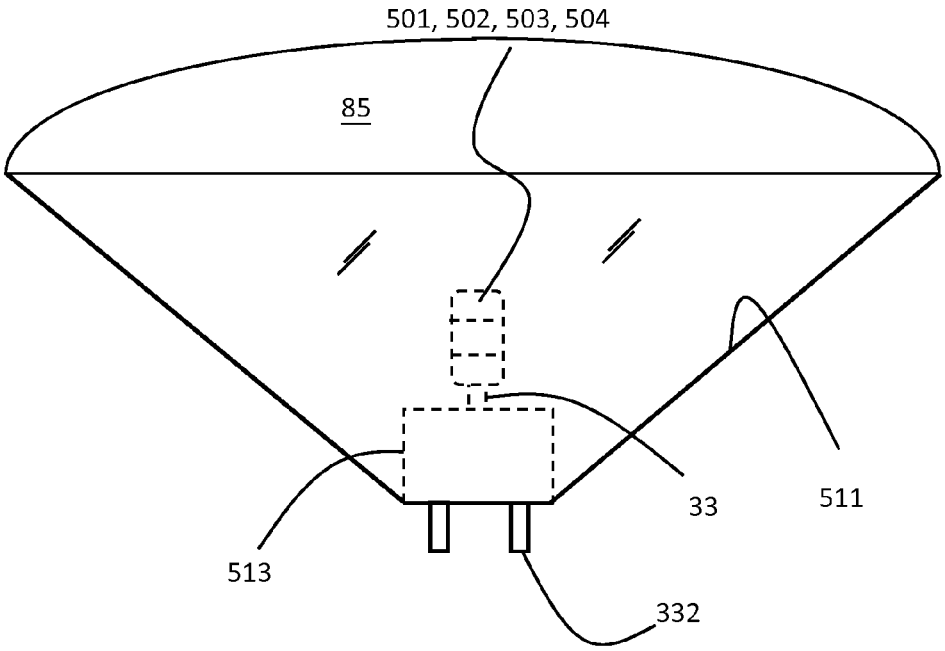
FIG. 15 shows a modification lamp to FIG. 14 according to the present invention.

FIG. 15 shows a modification lamp to FIG. 14 according to the present invention.

A protection cap 85 such as a transparent glass can be added on top of the reflection cup 511 for preventing the light source 501 (502, 503, 504) from being contaminated by the ambient dust.

While several embodiments have been described by way of example, it will be apparent to those skilled in the art that various modifications may be configured without departing from the spirit of the present invention. Such modifications are all within the scope of the present invention, as defined by the appended claims.

What is claimed is:

1. A double heat sink LED tube, comprising:

a first light unit, having a first lead;

a first light chip, configured on a bottom of the first lead;

a top heat sink, contacting a top portion of the first lead;

a second light unit, having a second lead;

a second light chip, configured on a top of the second lead; and a bottom heat sink, contacting a bottom portion of the second lead.

2. A double heat sink LED tube as claimed in claim 1, further comprising:

two electrode pins; each has a top end electrically coupling to the light chip, and has a second end protruded out of the bottom heat sink.

3. A double heat sink LED tube as claimed in claim 1, further comprising:

a protection tube, configured in between the top heat sink and the bottom sink.

4. A double heat sink LED tube as claimed in claim 1, further comprising:

a flexible circuit board, having:

a circuit electrically coupling to one lead of the light unit at a first end, and electrically coupling to a control center at a second end.

5. A double heat sink LED tube as claimed in claim 1, wherein one of he top heat sink and the bottom heat sink is a circular wall and having an inner surface contacting the lead of the light unit.

6. A double heat sink LED tube as claimed in claim 1, wherein the second light unit is configured longitudinally under the first light unit.

7. A double heat sink LED tube as claimed in claim 1, wherein the first light unit is configured horizontally side by side with the second light unit.

8. A double heat sink LED tube, comprising:

a first light unit, having a first top lead and a first bottom lead;

a first light chip, straddling the first top lead and the first bottom lead;

a top heat sink, contacting a top portion of the first top lead;

a second light unit, having a second top lead and a second bottom lead;

a second light chip, straddling the second top lead and the second bottom lead;

a bottom heat sink, contacting a bottom portion of the second bottom lead.

9. A double heat sink LED tube, comprising:

a top lead, having a top end, a bottom end, and a left downward branch;

a bottom lead, having a top end aligned with the downward branch; having an upward branch, aligned with a bottom end of a neighboring top lead;

a first light chip, straddling a bottom end of the downward branch and the top of the bottom lead; and a second light chip, straddling the bottom end of a neighboring top lead and a top end of the upward branch.

10. A double heat sink LED tube as claimed in claim 9, further comprising:

a top heat sink, contacting the top end of the top lead; and a bottom heat sink, contacting the bottom end of the bottom lead.

11. A double heat sink LED tube as claimed in claim 10, further comprising:

two electrode pins; each has a top end electrically coupling to the light chip, and has a second end protruded out of the bottom heat sink.

12. A double heat sink LED tube as claimed in claim 10, further comprising:

a protection tube, configured in between the top heat sink and the bottom heat sink.

13. A projection lamp, comprising:

a double heat sink LED tube as claimed in claim 1, as a light source; and a reflection cup, for reflecting light beams from the light source.

14. A projection lamp as claimed in claim 13, further comprising:

a lamp screw base, configured on a bottom of the cup.

15. A projection lamp as claimed in claim 13, further comprising:

an adjusting block, configured in between the light source and the lamp screw base.

16. A projection lamp as claimed in claim 13, further comprising:

a base, configured on bottom of the light source; and two electrode pins; each has a top end electrically coupling to one of the leads of the light source, and has a bottom end protruded out of a bottom of the block.

17. A projection lamp as claimed in claim 13, further comprising:

a transparent protection cap, configured on top of the reflection cup.

18. A projection lamp as claimed in claim 17, wherein the transparent protection cap is a glass cap.

* * * * *